US005226186A

United States Patent [19]

Boyd

[11] Patent Number: 5,226,186

[45] Date of Patent: Jul. 13, 1993

[54] WATERBED MATTRESS WITH DRAINING SYSTEM

[76] Inventor: Dennis Boyd, 14457 Rouge River, Chesterfield, Mo. 63017

[21] Appl. No.: 909,146

[22] Filed: Jul. 6, 1992

[51] Int. Cl.[5] ..... A47C 27/08

[52] U.S. Cl. ..... 5/451; 5/918; 141/65; 417/181

[58] Field of Search ..... 5/450–455, 5/918; 141/65; 417/151, 181

[56] References Cited

U.S. PATENT DOCUMENTS

| | | | |
|---|---|---|---|
| 1,212,479 | 1/1917 | Hall | 5/451 |
| 3,456,270 | 7/1969 | Weinstein et al. | 5/451 |
| 3,707,735 | 1/1973 | Carson, Jr. | 5/451 |
| 3,787,908 | 1/1974 | Beck et al. | 5/451 |
| 4,332,044 | 6/1982 | Houk, Jr. | 5/451 |
| 5,027,453 | 7/1991 | Koenig | 5/451 |
| 5,136,739 | 8/1992 | Ide | 5/918 |

*Primary Examiner*—Alexander Grosz

*Attorney, Agent, or Firm*—Polster, Lieder, Woodruff & Lucchesi

[57] ABSTRACT

A waterbed mattress has a watertight envelope having a top, a bottom and sides. The envelope defines a cavity for water. First and second valves are disposed in the envelope to selectively allow fluid communication between the cavity and the exterior of the envelope. The second valve is spaced from the first valve. Pump structure is operatively connected to the first and second valves for selectively evacuating water from the cavity. The pump structure includes a venturi member which operates inside the envelope to evacuate water from the envelope.

9 Claims, 1 Drawing Sheet

WATERBED MATTRESS WITH DRAINING SYSTEM

BACKGROUND OF THE INVENTION

This invention relates to waterbeds and more particularly to draining the water from waterbed mattresses.

Waterbed mattresses are known to provide many advantages in terms of comfort and restfulness. However, these mattresses are relatively heavy. As a result, from time to time it may become necessary to drain a waterbed mattress (when it is desired to move the waterbed to a new location, for example).

Conventionally, this has been done using a siphon device based in part on the venturi principle. This siphon device, called a drain pump or adapter is a separate plastic part which attaches to a water faucet. This adapter includes three ports. One is attached to the water faucet, one is a drain port, and the third is adapted to attach to a conventional garden hose. In use the other end of the garden hose is attached to the drain/fill valve of the waterbed mattress.

Water from the faucet flows through the adapter and, by means of the venturi effect, generates a partial vacuum in the adapter by the third port. This vacuum thereby acts through the garden hose to evacuate water from the waterbed mattress.

These conventional drain pumps can be improved. For example, these pumps are a separate piece which is relatively small and easily lost. It is quite common for the drain pumps to be lost because mattresses are drained relatively infrequently. In addition, since the drain/fill valve of the waterbed mattress is conventionally on the top of the mattress, the presently available drain pumps have difficulty draining the mattresses completely. Water in the bottom of the mattress or in anti-wave material such as fiber batting inside the mattress is very difficult to remove since the conventional drain pumps must work against gravity or similar forces to remove the water. As a result, the waterbed mattress, even when drained, retains so much water that it is still relatively heavy and somewhat difficult to pumps take an undesirably long time to drain a waterbed mattress.

SUMMARY OF THE INVENTION

Among the various objects and features of the present invention may be noted the provision of a waterbed mattress with improved drainability.

Another object is the provision of such a waterbed mattress which uses the force of gravity to assist drainage rather than oppose it.

A third object is the provision of such a waterbed mattress which makes it impossible to lose the drain pump.

A fourth object is the provision of a waterbed mattress drainage system which works well in draining fiber-containing mattresses.

A fifth object is the provision of such a waterbed mattress which is relatively inexpensive to construct.

A sixth object is the provision of such a waterbed mattress draining system which decreases the time needed to drain a waterbed mattress.

A seventh object is the provision of such a waterbed mattress draining system which increases the amount of water which can be readily removed from a waterbed mattress.

Other objects and features will be in part apparent and in part pointed out hereinafter.

Briefly, a waterbed mattress of the present invention includes a watertight envelope having a top, a bottom, and sides, which envelope defines a cavity for water therein. A first valve is disposed in the envelope to selectively allow fluid communication between the cavity and the exterior of the envelope. A second valve is disposed in the envelope, spaced from the first valve, to selectively allow fluid communication between the cavity and the exterior of the envelope. A pump with no moving parts is operatively connected to the first and second valves for selectively evacuating water from the cavity.

The method of draining a waterbed mattress of the present invention includes forcing water through a first hose into a fluid path extending through a waterbed mattress, generating a partial vacuum inside the waterbed mattress as a result of the flow of water through the fluid path, and draining the water from the first hose and from the interior of the waterbed mattress out of the waterbed mattress through a second hose.

BRIEF DESCRIPTION OF THE DRAWINGS

Similar reference characters indicate similar parts throughout the several views of the drawings.

DESCRIPTION OF THE PREFERRED EMBODIMENT

Figure 1:
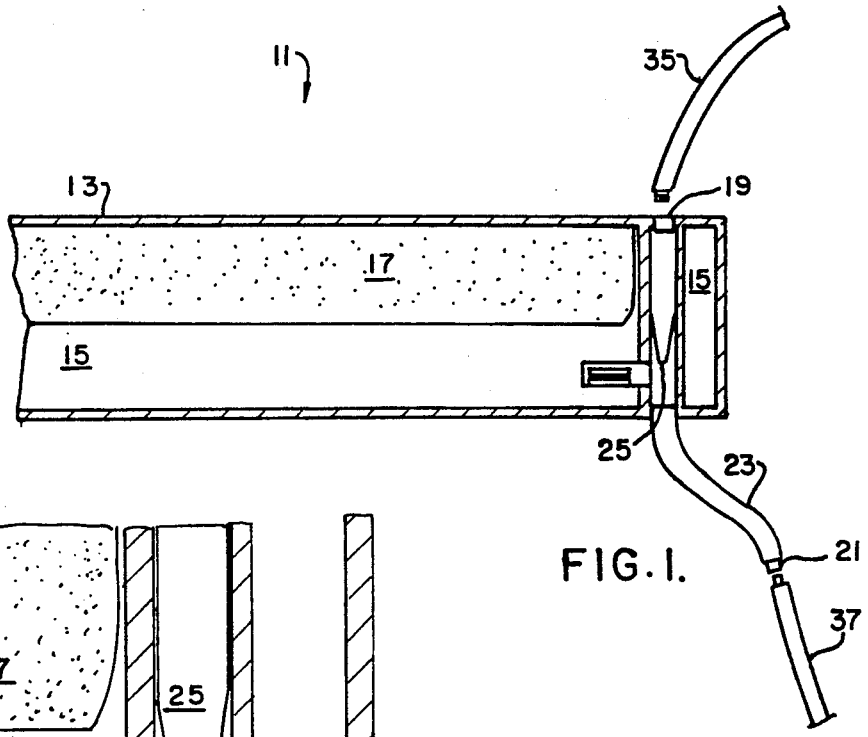
FIG. 1 is a partial sectional view of a waterbed mattress of the present invention.

Turning to the drawings, a waterbed mattress 11 (FIG. 1) of the present invention includes a watertight envelope 13 having a top, a bottom, and sides which define a cavity 15 for water. A batt 17 of wave-dampening material is shown in cavity 15, although the present invention does not require such a batt.

Mattress 11 includes first and second valves 19, 21 which are disposed in the walls of envelope 13 to selectively allow fluid communication between cavity 15 and the exterior of the envelope. More particularly, it is preferred that the first valve be disposed in the top of envelope 13 and that second valve 21 be disposed in or at the bottom of the envelope. As will become apparent, the two valves are connected by a preformed fluid path in which is disposed a draining or pump structure.

Although valve 21 may be disposed flush with the bottom of the envelope, it is preferred that it be connected thereto by an extension 23 for purposes explained below. Extension 23 may be formed of standard vinyl material such as that forming envelope 13.

Figure 2:
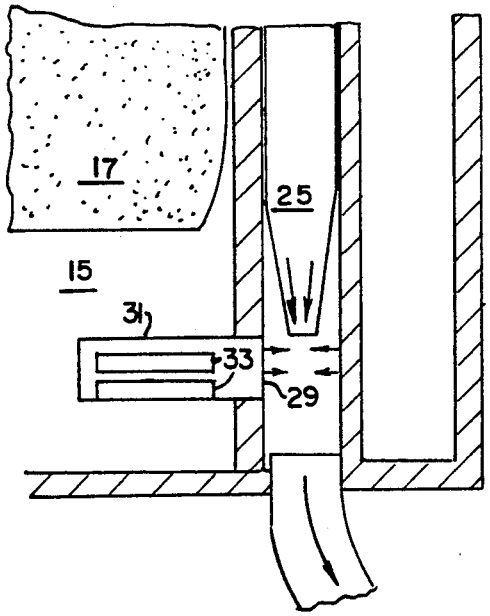
FIG. 2 is an enlarged sectional view of a portion of FIG. 1 illustrating the draining system of the present invention.

A venturi member 25 in the fluid path between valves 19 and 21 is disposed. Water flowing through venturi member 25, as indicated by the arrows in FIG. 2 at the tip of the funnel-shaped venturi member, creates a partial vacuum at the tip of the member. This partial vacuum is represented by the horizontal arrows below the tip of the venturi member in FIG. 2. This partial vacuum causes water to be drawn out of cavity 15 through a port 29 disposed adjacent the tip of the venturi member. Therefore, venturi member 25 in combination with port 29 constitutes pump means for selectively evacuating water from cavity 15.

Port 29 has attached thereto an elongate plastic extension or protrusion 31 which extends from the port into cavity 15. Protrusion 31 is formed with numerous slits 33 which allow the water to flow out of cavity 15 while preventing wave-dampening material 17 from exiting the cavity. This lattice structure also provides maximum exposure to water from all angles.

To operate the pump to drain waterbed mattress 11, the user attaches a conventional hose 35 (FIG. 1) at one end to valve 19 and at the other to a source of water under pressure (not shown) such as a conventional water faucet. A second hose 37 is attached to valve 21, with the other end of hose 37 disposed at a suitable drain (not shown) such as a conventional sink or bathtub. Water flowing through hose 35 passes through venturi member 25, thereby generating a partial vacuum which evacuates water from cavity 15. The water from the venturi member and the water from the cavity both pass through extension 23, valve 21, and hose 37 to the drain.

Because valve 21 is located in the bottom of waterbed mattress 11, the force of gravity assists in evacuating water from cavity 15. In fact, the cavity can be drained even without using the venturi effect of member 25 using the effect of gravity alone, although this significantly increases the time required to drain the mattress. It is preferred, therefore, that the venturi effect be used to drain the mattress.

Figure 3:
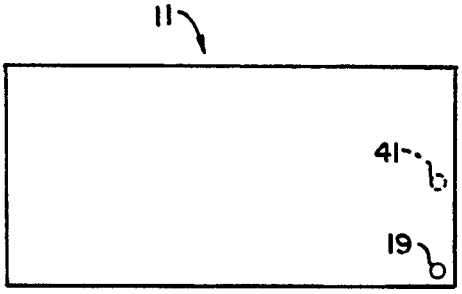
FIG. 3 is a top plan, on a reduced scale, of the waterbed mattress of FIG. 1.

Valve 19, the valve in the top of the mattress, is used as described above to drain cavity 15. It can also be used, if desired, to fill the waterbed. To fill the waterbed, hose 35 is attached to valve 19, but valve 21 is kept closed. Water then flows from the faucet, through hose 35 and valve 19 into the waterbed mattress. Alternatively, as shown in FIG. 3, a separate fill-valve 41 may be used to fill the waterbed mattress. Valve 41 would be conventional in construction.

It is preferred that the materials making up valve 19, venturi member 25, valve 21 (or extension 23), and protrusion 31 be heat sealable to the envelope 13 of the waterbed mattress. This facilitates the construction of mattress 11 since waterbed mattresses are commonly constructed using the heat sealing process.

Figure 5:
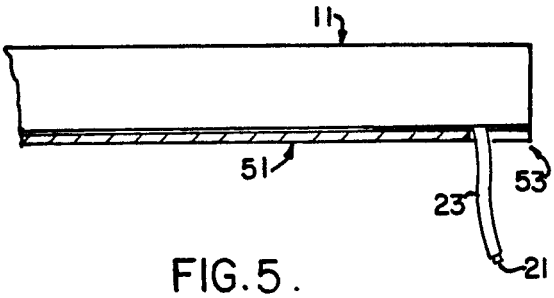
FIG. 5 is a sectional view illustrating the placement of the waterbed mattress of FIG. 1 in the frame of FIG. 4.
Figure 4:
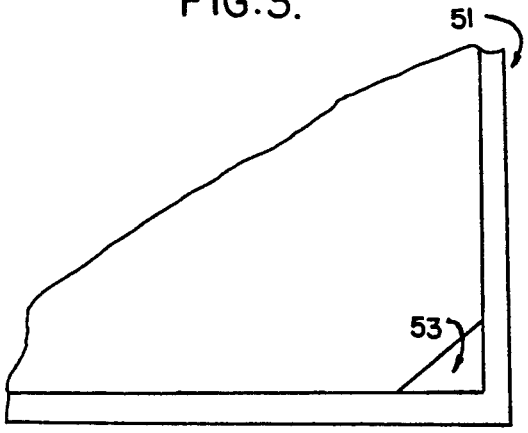
FIG. 4 is a top plan, on a reduced scale, of the frame for the waterbed mattress of FIG. 1.

Turning to FIGS. 4 and 5, it should be understood that mattress 11 is used with a conventional wooden frame such as frame 51 shown in FIG. 4. Such frames typically include a corner gap 53 through which electrical cables (not shown) pass. As is most clearly illustrated in FIG. 5, extension 23 passes down through gap 53 so that valve 21 is disposed below the level of mattress 11 for drainage. It is preferred that extension 23 be made of a suitable flexible material such as vinyl so that extension 23 may be folded upwardly to place valve 21 at the level of mattress 11 when the valve is not being used for draining the mattress.

In view of the above, it will be seen that the various objects and features of the present invention are achieved and other advantageous results obtained. The embodiments and the drawings of the invention disclosed herein are illustrative only and are not to be taken in a limiting sense.

What is claimed is:

1. A waterbed mattress comprising:

a watertight envelope having a top, a bottom, and sides, said envelope defining a cavity for water therein;

a first valve disposed in said envelope to selectively allow fluid communication between the cavity and the exterior of the envelope;

a second valve disposed in said envelope and spaced from said first valve to selectively allow fluid communication between the cavity and the exterior of the envelope;

a preformed fluid path between the top and the bottom of the envelope, connecting the first and second valves, said preformed path being substantially closed along its length, and having a port extending from the interior of the preformed fluid path to the cavity inside the envelope; and pump means disposed inside the preformed fluid path, said pump means being operatively connected to the first and second valves for selectively evacuating water from said cavity.

2. The waterbed mattress as set forth in claim 1 wherein the first valve is disposed in the top of said envelope.

3. The waterbed mattress as set forth in claim 1 wherein the pump means consists essentially of a venturi nozzle disposed in the preformed fluid path between the first and second valves in fluid communication therewith.

4. The waterbed mattress as set forth in claim 1 wherein the port includes a preformed extension extending into the cavity from the preformed fluid path.

5. The waterbed mattress as set forth in claim 1 wherein the port is disposed toward the bottom of the preformed fluid path.

6. The waterbed mattress as set forth in claim 1 wherein the port includes a lateral protrusion extending into the envelope cavity, said protrusion allowing fluid communication between the cavity and the preformed fluid path.

7. The waterbed mattress as set forth in claim 1 further including a third valve adapted to permit filling the envelope cavity with water, said third valve being disposed in the top of the envelope.

8. The waterbed mattress as set forth in claim 1 wherein the second valve is disposed in the bottom of the envelope, further including an extension member secured to the second valve and extending away from the envelope, said extension member having a length on the order of the height of the waterbed mattress and having means for attachment to a hose.

9. A method of draining a waterbed mattress comprising:

forcing water through a first hose into a fluid path extending from top to bottom through a waterbed mattress;

generating a partial vacuum inside the waterbed mattress as a result of the flow of water through said fluid path; and draining the water from the first hose and from the interior of the waterbed mattress out of the bottom of the waterbed mattress through a second hose, so that gravity assists the partial vacuum in draining the mattress.

* * * * *

UNITED STATES PATENT AND TRADEMARK OFFICE

CERTIFICATE OF CORRECTION

PATENT NO. :5,226,186
DATED :July 13, 1993
INVENTOR(S) :Dennis Boyd

It is certified that error appears in the above-indentified patent and that said Letters Patent is hereby corrected as shown below:

Column 1, line 44 and 45 is "somewhat difficult to pumps take an undesirably long time to drain a waterbed mattress" should be -- somewhat difficult to move. Moreover, because of all these effects, a conventional drain pumps take an undesirably long tome to drain a waterbed mattress--.

Signed and Sealed this

Fifteenth Day of March, 1994

*Attest:*

Bruce Lehman

BRUCE LEHMAN

*Attesting Officer*

*Commissioner of Patents and Trademarks*